US005561960A

United States Patent [19]

Minnick et al.

[11] Patent Number: 5,561,960

[45] Date of Patent: Oct. 8, 1996

[54] MODULAR WALL PANEL SYSTEM

[75] Inventors: Larry A. Minnick; Stephen L. Mitchell, both of Indianapolis; Daniel L. Weddle, Danville, all of Ind.

[73] Assignee: The Exhibit House, Inc., Indianapolis, Ind.

[21] Appl. No.: 423,900

[22] Filed: Apr. 18, 1995

[51] Int. Cl.[6] ..... E04B 2/08; E04H 1/00

[52] U.S. Cl. ..... 52/578; 403/386; 52/239; 52/271; 52/309.11

[58] Field of Search ..... 403/381, 384, 403/386; 52/271, 309.4, 309.9, 309.11, 592.6, 585.1, 578, 587.1, 586.1, 582.2, 590.2, 239

[56] References Cited

U.S. PATENT DOCUMENTS

| | | | |
|---|---|---|---|
| 2,970,677 | 2/1961 | Springs, Jr. et al. | 52/239 |
| 3,513,606 | 5/1970 | Jones | 52/239 X |
| 4,067,165 | 1/1978 | Timmons | 52/585.1 |
| 4,109,429 | 8/1978 | Whisson | 52/239 X |
| 4,274,242 | 6/1981 | Linton et al. | 52/309.11 X |
| 4,862,660 | 9/1989 | Raymond | 52/309.11 X |
| 5,065,559 | 11/1991 | Zegel et al. | 52/582.2 X |
| 5,287,666 | 2/1994 | Frascaroli et al. | 52/271 X |

FOREIGN PATENT DOCUMENTS

| | | | |
|---|---|---|---|
| 1137278 | 5/1957 | France | 52/239 |

*Primary Examiner*—Wynn E. Wood
*Attorney, Agent, or Firm*—Woodard, Emhardt, Naughton, Moriarty & McNett

[57] ABSTRACT

A modular wall panel system in which individual panels are constructed with a lightweight aluminum frame. In a preferred embodiment, the frame is substantially filled with a foam core material and decorative display surfaces are affixed to opposite sides thereof. One edge of the panels contains a plurality of specially shaped connector pins, while the opposite edge has a plurality of connector slots having a "dogbone" configuration. Therefore, a similar panel placed adjacent to the first panel may be mated thereto by engagement of the connector pins with respective connector slots in the other panel. The pins/slots are shaped and sized so that the connector pin may enter/exit the connector slot at either end of the dogbone but not in the center slot of the dogbone. Secure coupling with fast assembly/disassembly is thereby achieved, without tools or detachable components. Furthermore, the dogbone shape of the slot allows panels to be removed from either side.

15 Claims, 9 Drawing Sheets

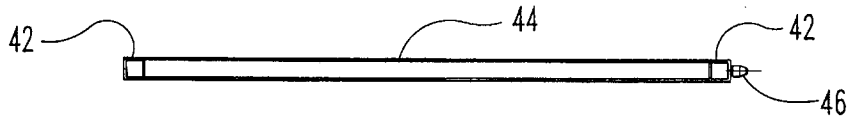
Fig. 6
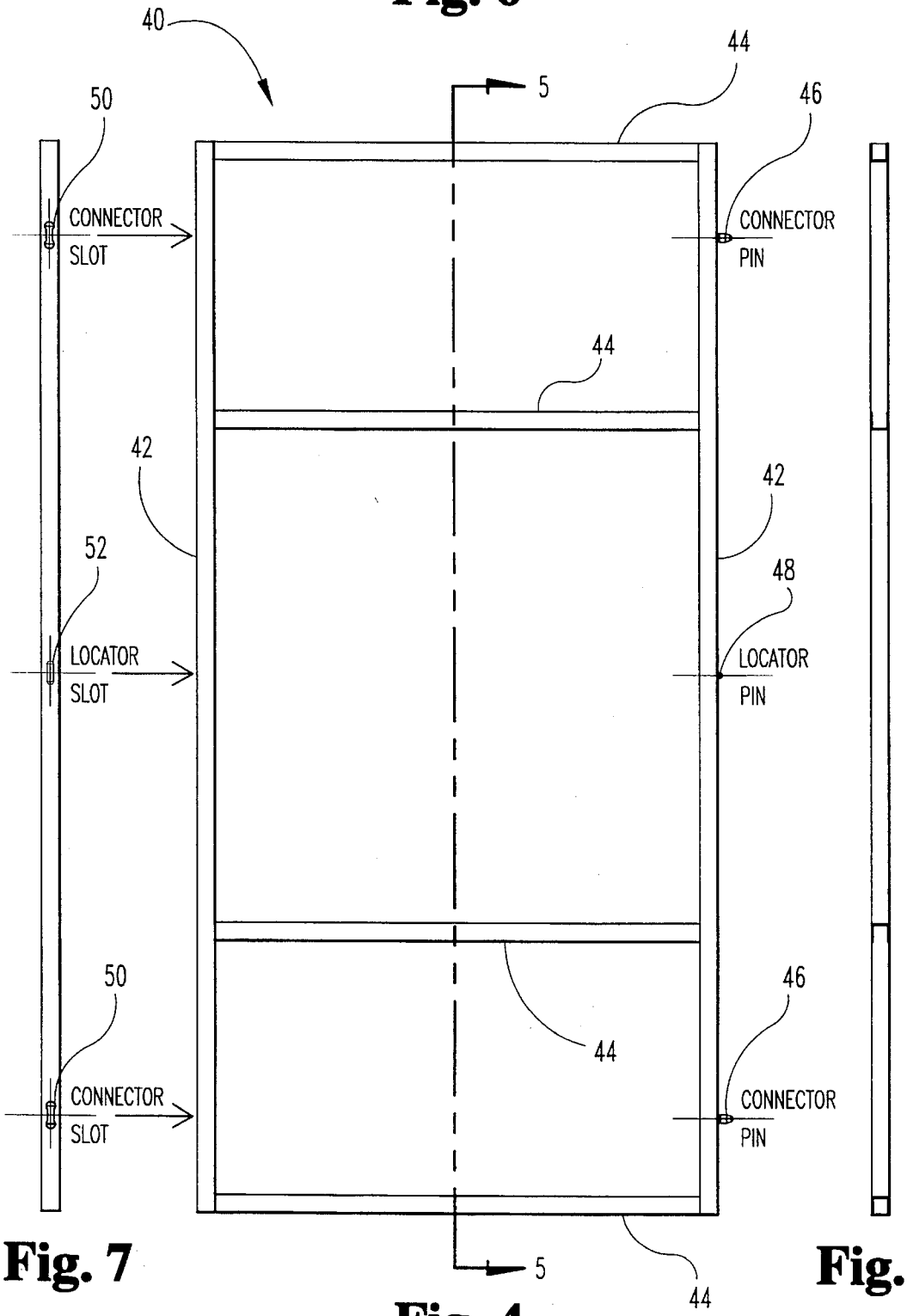
Fig. 7
Fig. 5
Fig. 4

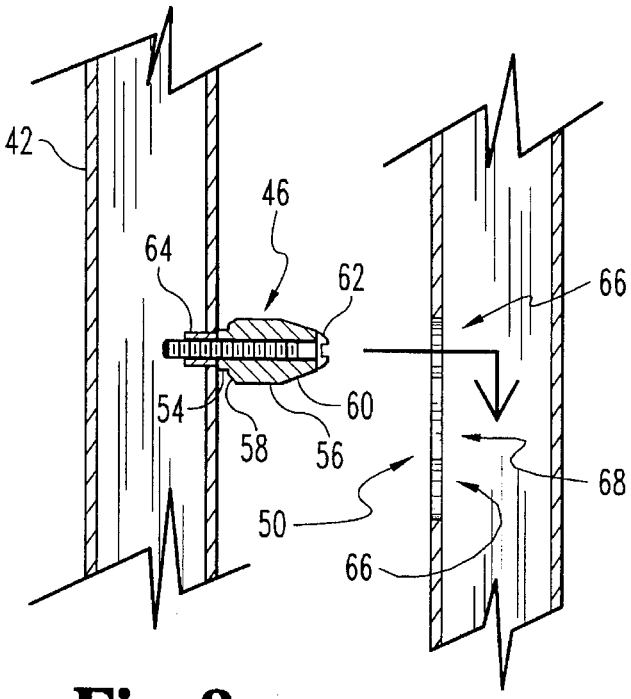
Fig. 8
Fig. 10
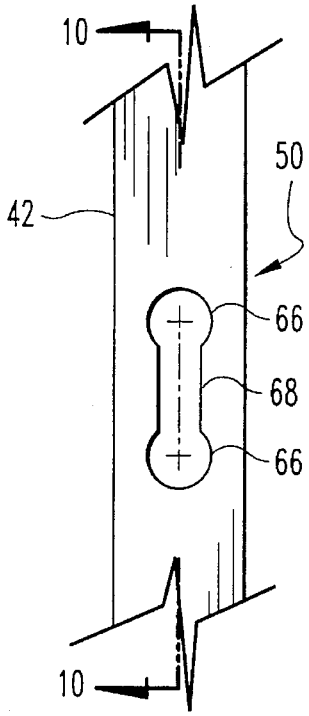
Fig. 9
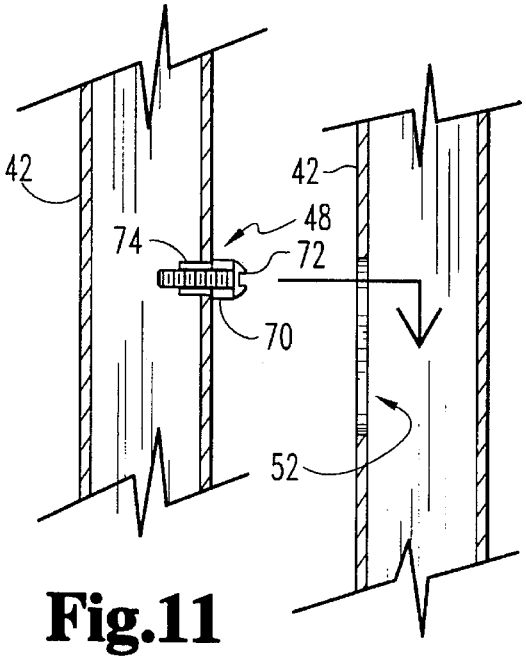
Fig.11
Fig.13
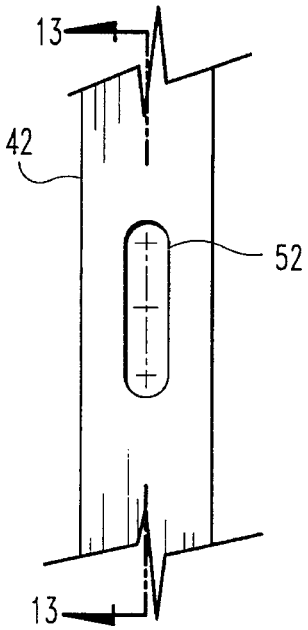
Fig. 12

MODULAR WALL PANEL SYSTEM

TECHNICAL FIELD OF THE INVENTION

Present invention relates generally to a modular wall panel system and, more particularly, to a modular wall panel system which allows for interconnection of adjacent panels without the need for tools and/or detachable parts.

BACKGROUND OF THE INVENTION

Portable displays have found wide usage in today's business environment, particularly with respect to businesses which participate in conventions, trade shows, seminars and other such events. Due to the nature of this application, such portable displays are typically assembled and disassembled by a limited number of persons at the exhibition site. Thus, a basic design requirement of such portable display devices is a minimization of weight and structural complexity, coupled with a maximization of durability and aesthetic appearance. Generally, prior art display devices sacrifice one of these design factors in favor of another, i.e. known systems which are durable and attractive are also cumbersome, heavy and complicated to assemble, or known systems which are lightweight and easy to assemble lack sufficient durability to withstand constant assembly and disassembly. In the extremely competitive sales environments in which trade show exhibits are commonly used, the owner is usually not willing to sacrifice durability or aesthetic appearance. Therefore, typical prior art exhibit display devices are heavy, awkward to transport and require a complicated and cumbersome assembly process.

The conventional trade show display is a semi-permanent reusable display designed for long-term usage. These are generally custom fabricated, and are very heavy and durable, allowing for frequent reuse. Such displays are very costly to buy as well as to use. For transport, the displays must be broken down into numerous component parts, which are then crated for shipping. In a typical installation, such assemblies must be received at a proper loading dock and constructed by the exhibit site personnel at a substantial cost. Frequently, only venue employees are allowed to unload and construct the exhibit display. This can dramatically increase the costs of setting up a large exhibit. For example, an exhibit display large enough to fill a semi-trailer may cost approximately $4,000 to ship across the country. However, local drayage (the unloading of the trailer at the exhibit dock and the carrying of the exhibit pieces to the display area) may cost an equal amount, just to move the exhibit display pieces the final 100 feet. These local drayage costs are based upon the manpower required to unload the exhibit display and the time required for doing so. These factors are typically directly related to the weight and size of the individual exhibit display pieces. Extremely high drayage costs are the norm in the trade show exhibit industry, owing to the fact that the exhibit displays must be sturdily constructed in order to withstand constant assembly, disassembly and shipping. The modular panels used in existing exhibit displays are typically large, heavy and cumbersome, requiring two men to carry each modular panel.

A typical prior art modular wall panel system for use at a trade show exhibit is illustrated if FIG. 1 and indicated generally at 10. Each panel of the prior art modular exhibit 10 includes a frame constructed from vertical support members 12 and horizontal support members 14. The supports 12 and 14 are typically 1"×4" wooden boards. These boards are stapled and/or screwed to one another in order to form a rigid frame for each modular panel. A decorative outer skin (not shown) is then placed over one side of the frame. In such prior art modular display systems 10, in which the rear side of each display panel is hidden from view and therefore does not include a rear outer skin covering, adjacent panels of the display 10 may be secured to one another by means of bolts 16 and nuts 18 which engage appropriate holes drilled through the frames. Because there is no rear outer skin on such display panels, access may be had to the bolts 16 and nuts 18 through the rear of the display for assembly and disassembly.

However, the prior art exhibit display 10 has several drawbacks. First, because it is constructed with a wooden frame, it is extremely heavy and bulky, requiring two persons to carry an average sized panel (8'×4'×4"). Furthermore, the use of bolts 16 and nuts 18 to interconnect adjoining panels requires a very labor intensive and lengthy assembly time. Furthermore, tools are required for such assembly and disassembly and it is nearly impossible to guarantee that nuts and bolts will not be lost during such operations.

A second type of prior art exhibit display is illustrated in FIG. 2 and indicated generally at 20. Like the display panels 10 of FIG. 1, the display 20 utilizes frames constructed from 1"×4" wooden supports 12 and 14. However, the panels of the display system 20 contain outer decorative skins (not shown) on beth the front and back sides thereof, intended for viewing from either side. Because the rear side of such displays are covered by the decorative outer skin, it is not possible to utilize the bolts 16 and nuts 18 of the display system 10 because access may not be had to these for disassembly. The display panels 20 are therefore constructed using rotary locks comprising male portions 22 and female portions 24. Such rotary locks are operated by means of an allen wrench key 26. The key 25 is inserted through a small hole formed in the outer skin on one side of the display panel.

The rotary lock system is illustrated in greater detail in FIG. 3. The display panel system 20 of FIG. 3 is illustrated with the front outer skin removed so that the rotary lock system is exposed to view. The male portion 22 and female portion 24 of the rotary lock are each joined to the inside surface of one of the vertical support members 12 of the display unit frame. The rotary lock portions 22 and 24 are mounted over longitudinal slots 28 formed through the vertical support members 12. When the rotary lock key 26 is inserted into the keyhole 30 in the male portion 22 and rotated, a hook 32 is caused to extend through the slot 28 adjacent the male portion 22. When the two panels of the display system 20 are adjacent one another, extension of the hook 32 causes it to enter the slot 28 adjacent the female portion 24 and to engage a transverse bar (not shown) within the female portion 24. The transverse bar is rigidly attached within the female portion 24 by means of the connector 34. By this means, the adjoining panels in the display system 20 are rigidly affixed to one another by turning of the key 26 of the rotary lock. Similarly, the adjoining panels are disengaged from one another by turning the key 26 in the opposite direction.

Although the rotary lock of the display system 20 of FIGS. 2 and 3 eliminates the cumbersome assembly and disassembly of the bolts and nuts of the display system 10, the rotary lock adds weight and complexity to the display system 20 and also requires that the key 25 be maintained in close proximity to the display system 20. If the key 26 is lost, the exhibit display may not be constructed or disassembled. Furthermore, the display system 20 exhibits even more weight and bulk than the display system 10.

There is therefore a need in the prior art for a display system which may be easily assembled and disassembled at exhibit trade shows, which has substantially less weight and bulk than prior art display systems, such that transportation and drayage costs of the modular panels are reduced, yet which retains the durability and aesthetic appearance of the high quality prior art display panels. The present invention is directed toward meeting these needs.

SUMMARY OF THE INVENTION

The present invention relates to a modular wall panel system in which individual panels are constructed with a lightweight aluminum frame. In a preferred embodiment, the frame is substantially filled with a foam core material and decorative display surfaces are affixed to opposite sides thereof. One edge of the panels contains a plurality of specially shaped connector pins, while the opposite edge has a plurality of connector slots having a "dogbone" configuration. Therefore, a similar panel placed adjacent to the first panel may be mated thereto by engagement of the connector pins with respective connector slots in the other panel. The pins/slots are shaded and sized so that the connector pin may enter/exit the connector slot at either end of the dogbone but not in the center slot of the dogbone. Secure coupling with fast assembly/disassembly is thereby achieved, without tools or detachable components. Furthermore, the dogbone shape of the slot allows panels to be removed from either side.

In one form of the invention, a modular wall panel is disclosed, comprising a first aluminum vertical support member forming a first side of the panel, a second aluminum vertical support member forming a second side of the panel, a plurality of aluminum horizontal support members coupled between the first and second vertical support members, thereby forming a panel frame, a first display surface coupled to the panel frame and forming a third side of the panel, a second display surface coupled to the panel frame and forming a fourth side of the panel, a plurality of connector pins coupled to the first vertical support member and extending substantially perpendicular to the first side, each of the connector pins having a first diameter at a first junction between the connector pin and the first side, and a second diameter at a point on the connector pin spaced from the first junction, wherein the second diameter is larger than the first diameter and a plurality of connector slots formed in the second vertical support member, each of the connector slots having a dogbone shape comprising two spaced apart end portions connected with a central slot, wherein a third diameter of the end portions is larger than the second diameter and a first width of the central slot is larger than the first diameter and smaller than the second diameter wherein first and second adjacent wall panels may be releasably coupled by vertically raising the first panel with respect to the second panel until the connector pins of the first panel are aligned with one of the end portions of corresponding connector slots of the second panel, moving the first panel toward the second panel and then vertically lowering the first panel to substantially a level of the second panel such that each of the connector pins is retained in the central slot of the corresponding connector slot.

In another form of the invention a modular wall panel is disclosed, comprising a first aluminum vertical support member forming a first side of the panel, a second aluminum vertical support member forming a second side of the panel, a plurality of aluminum horizontal support members coupled between the first and second vertical support members, thereby forming a panel frame, a first display surface coupled to the panel frame and forming a third side of the panel, a second display surface coupled to the panel frame and forming a fourth side of the panel, a plurality of connector pins coupled at a first junction to the first vertical support member and extending substantially perpendicular to the first side, each of the connector pins comprising a first cylindrical portion having a first outside diameter, a second cylindrical portion having a second outside diameter, the second outside diameter being greater than the first outside diameter, a first frustoconical portion extending between the first and second cylindrical portions, the first frustoconical portion providing at least a partial transition between the first and second outside diameters and a second frustoconical portion extending from the second cylindrical portion on a side opposite a second junction between the first frustoconical portion and the second cylindrical portion.

In another form of the invention, a modular wall panel is disclosed, comprising a first aluminum vertical support member forming a first side of the panel, a second aluminum vertical support member forming a second side of the panel, a plurality of aluminum horizontal support members coupled between the first and second vertical support members, thereby forming a panel frame, a first display surface coupled to the panel frame and forming a third side of the panel, a second display surface coupled to the panel frame and forming a fourth side of the panel, a plurality of connector pins coupled to the first vertical support member and extending substantially perpendicular to the first side, each of the connector pins having a first diameter at a first junction between the connector pin and the first side, and a second diameter at a point on the connector pin spaced from the first junction, wherein the second diameter is larger than the first diameter and at least one foam core member substantially filling a cavity defined by the first and second vertical support members, the first and second display surfaces and two of the plurality of horizontal support members.

BRIEF DESCRIPTION OF THE DRAWINGS

FIG. 4 is a front elevational view of a first embodiment of the present invention.

FIG. 5 is a cross sectional view of the first embodiment of the present invention.

FIG. 6 is a top plan view of the first embodiment of the present invention.

FIG. 7 is a left side elevational view of the first embodiment if the present invention.

FIG. 8 is a cross sectional view of a connector pin of the first embodiment of the present invention.

FIG. 9 is an elevational view of a connector slot of the first embodiment of the present invention.

FIG. 10 is a cross sectional view of the connector slot of FIG. 9.

FIG. 11 is a cross sectional view of a locator pin of the present invention.

FIG. 12 is a side elevational view of a locator slot of the present invention.

FIG. 13 is a cross sectional view of the locator slot of FIG. 12.

DESCRIPTION OF THE PREFERRED EMBODIMENT

Figure 2:
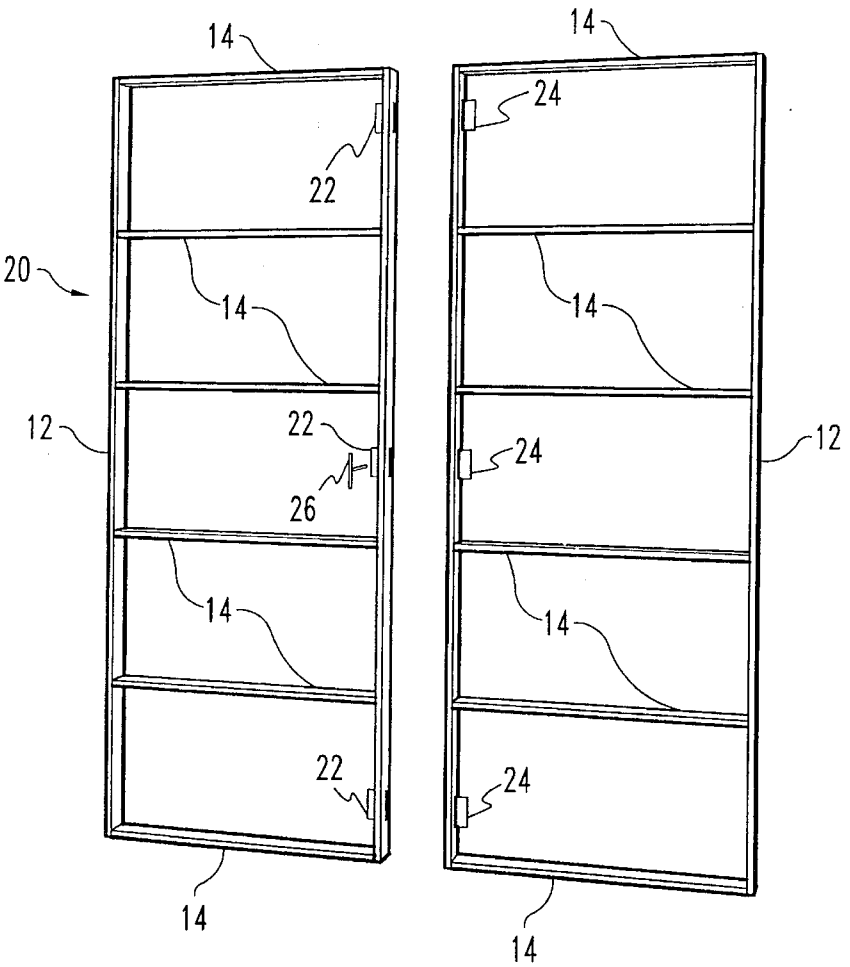
Fig. 2 (Prior Art)
FIG. 2 is a perspective view of a second embodiment prior art module panel display system.
Figure 1:
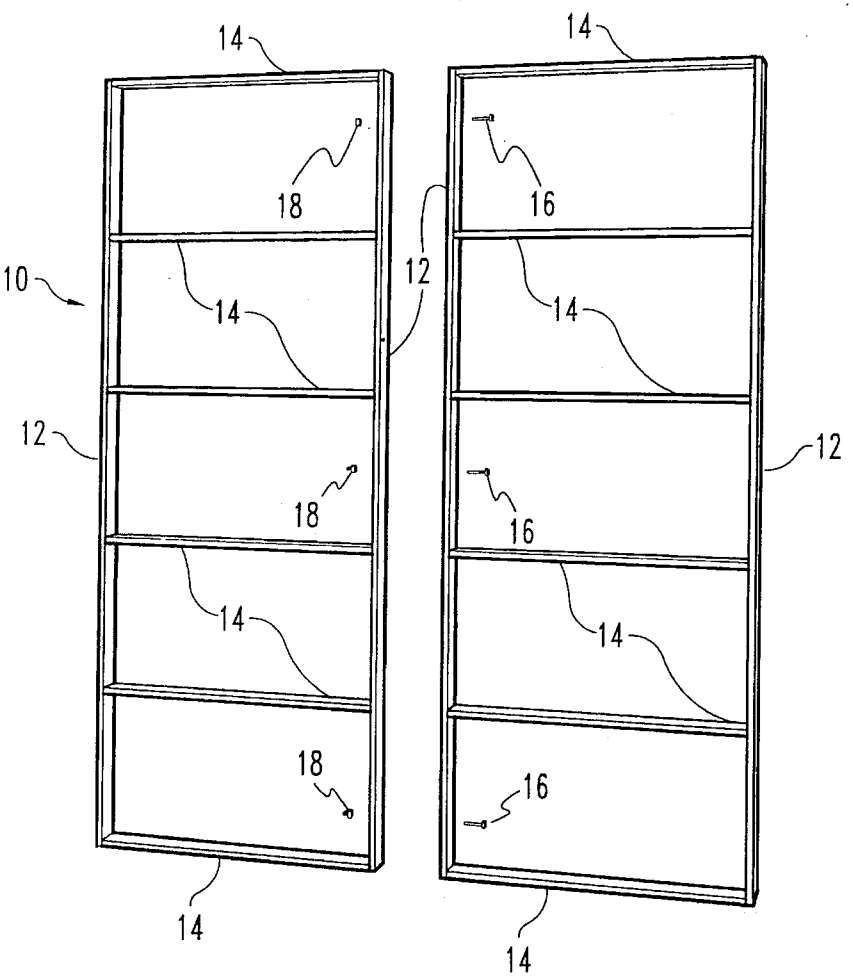
Fig. 1 (Prior Art)
FIG. 1 is a perspective view of a first embodiment prior art modular panel display system.
Figure 3:
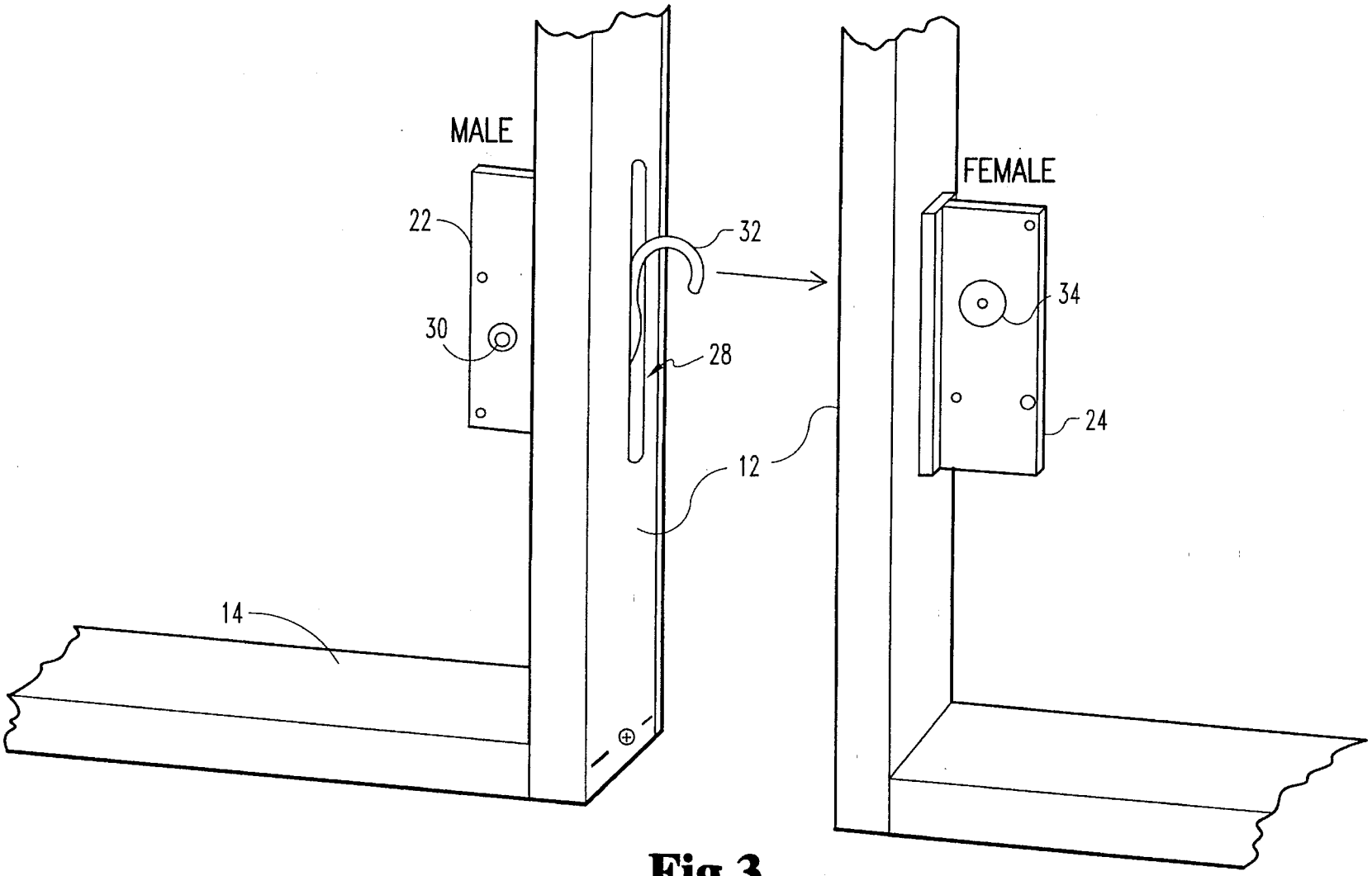
Fig.3 (Prior Art)
FIG. 3 is a perspective view of a rotary lock system used on the second embodiment prior art modular panel display system of FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides for a modular panel wall system having individual wall panels which are approximately half the thickness and half the weight of prior art wall panel systems. Not only does this reduce the shipping costs associated with transporting the disassembled exhibit across the country, but it also significantly decreases the drayage costs at the exhibit site, due to the fact that the wall panels of the present invention are light enough to be handled by a single person. Even so, the panels of the present invention retain the rigidity, aesthetic quality, and durability of the wall panels of the prior art systems. Furthermore, the modular wall panels of the present invention include a system for interconnecting adjacent panels which does not require any tools or separate parts to affect such coupling.

Referring to FIG. 4, there is illustrated a first embodiment wall panel of the present invention, indicated generally at 40. Each of the panels 40 has a frame formed from vertical support members 42 and horizontal support members 44. Both the vertical support members 42 and the horizontal support members 44 are formed from aluminum. In a preferred embodiment, the vertical support members 42 are formed from substantially square aluminum tubing having dimensions of 1½"×1 1/2". Also in a preferred embodiment, the horizontal support members 44 are formed from 1½"1" aluminum U-channel members. The horizontal cross members 44 are affixed to the vertical support members 42 by any convenient means, such as by welding. The use of aluminum in the frame construction of the modular panel 40 results in a modular panel having less than one-half the weight and thickness of the prior art wall panels, yet retaining approximately the same strength and rigidity. The horizontal support members 44 are formed from U-channel material rather than from full tubes in order to further decrease the weight of the finished unit. The placement of the horizontal support members 44 is illustrated in the cross sectional view of FIG. 5. The configuration of the vertical support members 42 is more clearly illustrated in the plan view of FIG. 6.

The right side of each modular wall panel 40 is provided with two connector pins 46, located near the upper and lower ends thereof. Furthermore, a locator pin 48 is coupled to the right side of the wall panel 40 substantially in the middle of the right hand vertical support member 42. Referring to FIG. 7, each wall panel 40 further includes two connector slots 50 formed in the left hand vertical support member 42 thereof. The connector slots 50 are located at the same vertical locations as the connector pins 46. Furthermore, a locator slot 52 is formed in the left hand vertical support member 42 at the same vertical location as the locator pin 48. As described in greater detail hereinbelow, the connector pins 46 are designed to fit in locking engagement with the connector slots 50 of an adjacent wall panel 40. Likewise, the locator pins 48 are designed to engage the locator slot 52 of an adjacent wall panel 40, although the locator pin does not fit in locking engagement with the locator slot. The use of the pins and complementary slots in the first embodiment of the present invention allows for adjacent wall panels 40 to be coupled to one another without the use of any tools and without requiring separate parts which may become separated from the wall panels 40. Furthermore, the connector pin/connector slot arrangement of the present invention allows for extremely quick assembly and disassembly of the exhibit display (from either direction), dramatically reducing the costs associated with these operations.

With reference to FIGS. 8–10, the connector pin 46 and connector slot 50 engagement is illustrated in greater detail. The connector pin 46 is preferably formed from a machined piece of aluminum having a first cylindrical portion 54, a second cylindrical portion 56, and a first frustoconical portion 58 joining the first and second cylindrical portions. Finally, the connector pin 46 includes a second frustoconical portion 60 adjoining the opposite side of the second cylindrical portion 56. The connector pin 46 is joined to the vertical support member 42 by means of an allen head machine screw 62 which extends longitudinally through the center thereof. The screw 62 threadingly engages a threaded insert 64 which is held in the vertical support member 42 by an interference fit with a mounting hole formed for this purpose. The largest exterior dimension of the connector pin 46 is the diameter of the second cylindrical surface 56.

The connector slot 50 is designed in a "dogbone" configuration having end portions 66 of increased diameter coupled by a slot 68 of reduced diameter. The diameter of the end portion 66 is chosen to be slightly larger than the diameter of the second cylindrical portion 56 of the connector pin 46. The width of the slot 68 is chosen to be slightly larger than the diameter of the first cylindrical portion 54 of the connector pin 46, but smaller than the diameter of the second cylindrical portion 56. In this manner, as illustrated in FIG. 10, the connector pin 46 may be inserted through either of the enlarged portions 65 of the connector slot 50 until the connector pin 46 lies substantially within the vertical support member 42. At this point the connector pin 46 may be slid into alignment with the slot 68, wherein the connector pin 46 is thereby locked within the connector slot 50. Because the diameter of the second cylindrical portion 56 of the connector pin 46 is larger than the width of the slot 68, the connector pin 46 is prevented from exiting the connector slot 50 when it is arranged in the central position. Thus, the two adjacent wall panels 40 are effectively locked together once the connector pin 46 has been properly inserted into the connector slot 50.

Provision of mating connector pins 46/connector slots 50 near the top and bottom of each modular wall panel 40 insures the panels 40 will be rigidly coupled together. The frustoconical portions 58 and 60 of the connector pin 46 allow for smooth mating and unmating of the connector pin 46 with the connector slot 50. Because both the connector pin 46 and the connector slot 50 are formed from similar aluminum materials, there is very little appreciable wear on either member, insuring the connector system of the present invention will outlast the useful life of the modular wall panel 40.

As best illustrated in FIGS. 11–13, the locator pin 48 is formed from a cylindrical portion 70 which is attached to the vertical support member 42 by means of an allen head machine screw 72. The screw 72 threadingly engages a threaded insert 74 which is maintained in the vertical support member 42 by means of an interference fit with a mounting hole formed therein for this purpose. Unlike the multiple surfaces of the connector pin 46, the locator pin 48 has a single diameter throughout substantially its entire length. Furthermore, the locator slot 52 has substantially the same width throughout its entire length. The width of the locator slot 52 is chosen to be slightly larger than the width of the cylindrical portion 70 of the locator pin 48. Therefore, the engagement of the locator pin 48 with the locator slot 52 does not result in any locking engagement between adjacent wall panels 40. Rather, the locator pin 48/locator slot 52 combination is provided merely as an alignment guide which facilitates the proper mating of the two connector pins 46 with their respective connector slots 50.

It will be appreciated by those skilled in the art that the use of the specially shaped connector pin 46 and the connector slot 50 having a dogbone shape allows for assembly and disassembly of adjacent wall panels 40 in any order. For example, once the wall panels 40 are assembled, disassembly, of the panels requires that one panel be raised vertically relative to its adjacent neighbor so that the connector pins 46 may be aligned with the enlarged portions 66 of the connector slots 50 and removed therefrom. Because of the dogbone configuration of the connector slots 50, either the panel having the connector slot 50 or the panel having the connector pin 46 may be vertically raised in order to affect decoupling between the two wall panels. Because either of the adjacent panels may be lifted and removed from the other panel, disassembly of an exhibit may be made from either end, or from both ends simultaneously. This design therefore offers a significant advantage over connection schemes which require that adjacent panels be disassembled from a particular side.

Figure 14:
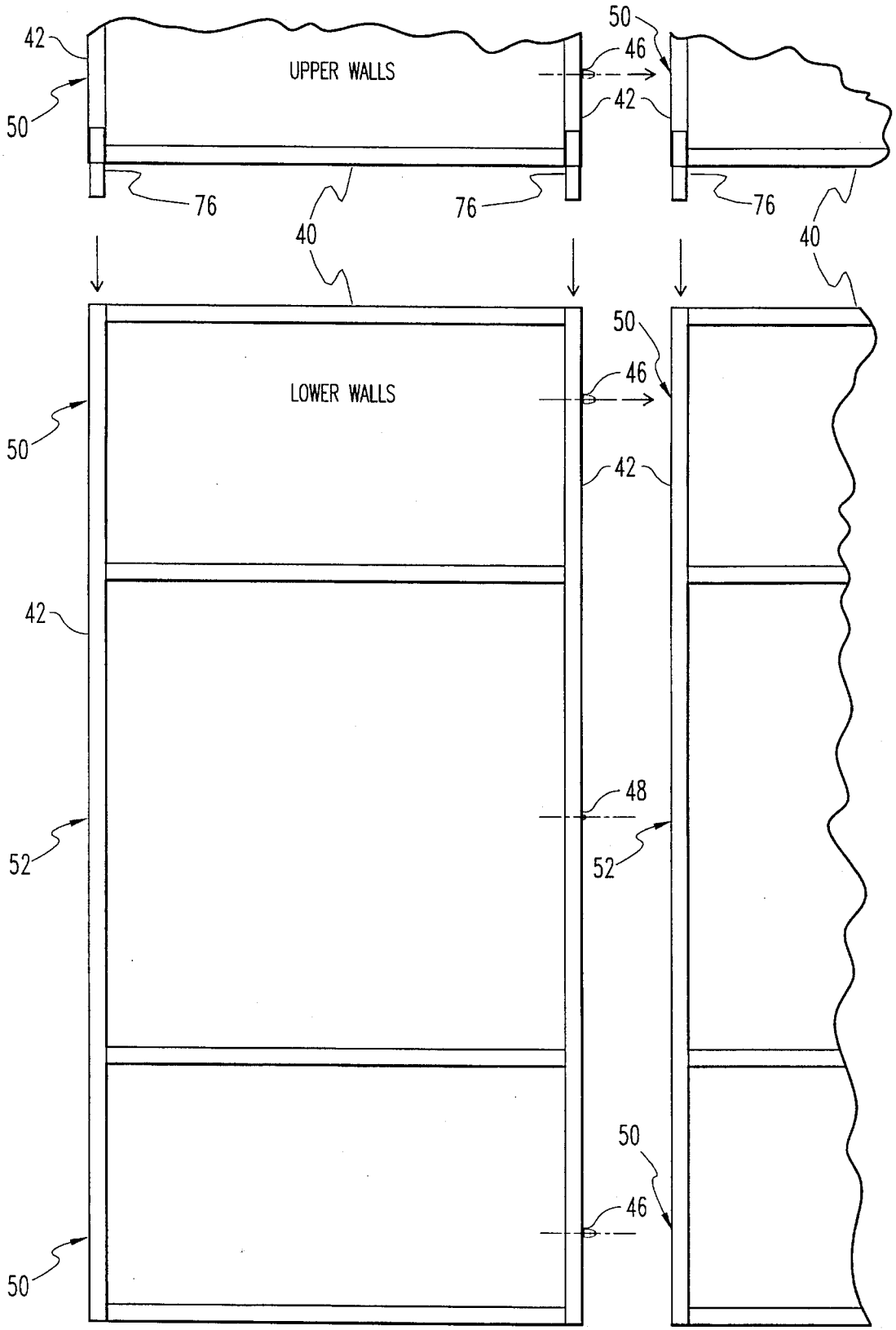
FIG. 14 is an elevational view of the first embodiment of the present invention, showing connection between adjacent display panels.

Referring now to FIG. 14, it is illustrated how the modular panels 40 of the present invention may be coupled horizontally as well as vertically in order to form a grid of the modular panels 40. Horizontal coupling of the modular panels 40 is affected by engagement of connector pins 46 with connector slots 50 as described in detail hereinabove. Vertical coupling of adjacent modular walls 40 is effected by means of short sections of 1¼"×1 1/4" aluminum tube 76 which is sleeved into the 1½"×1 1/2" square tube of the vertical support members 42 of each modular panel 40.

Figure 15:
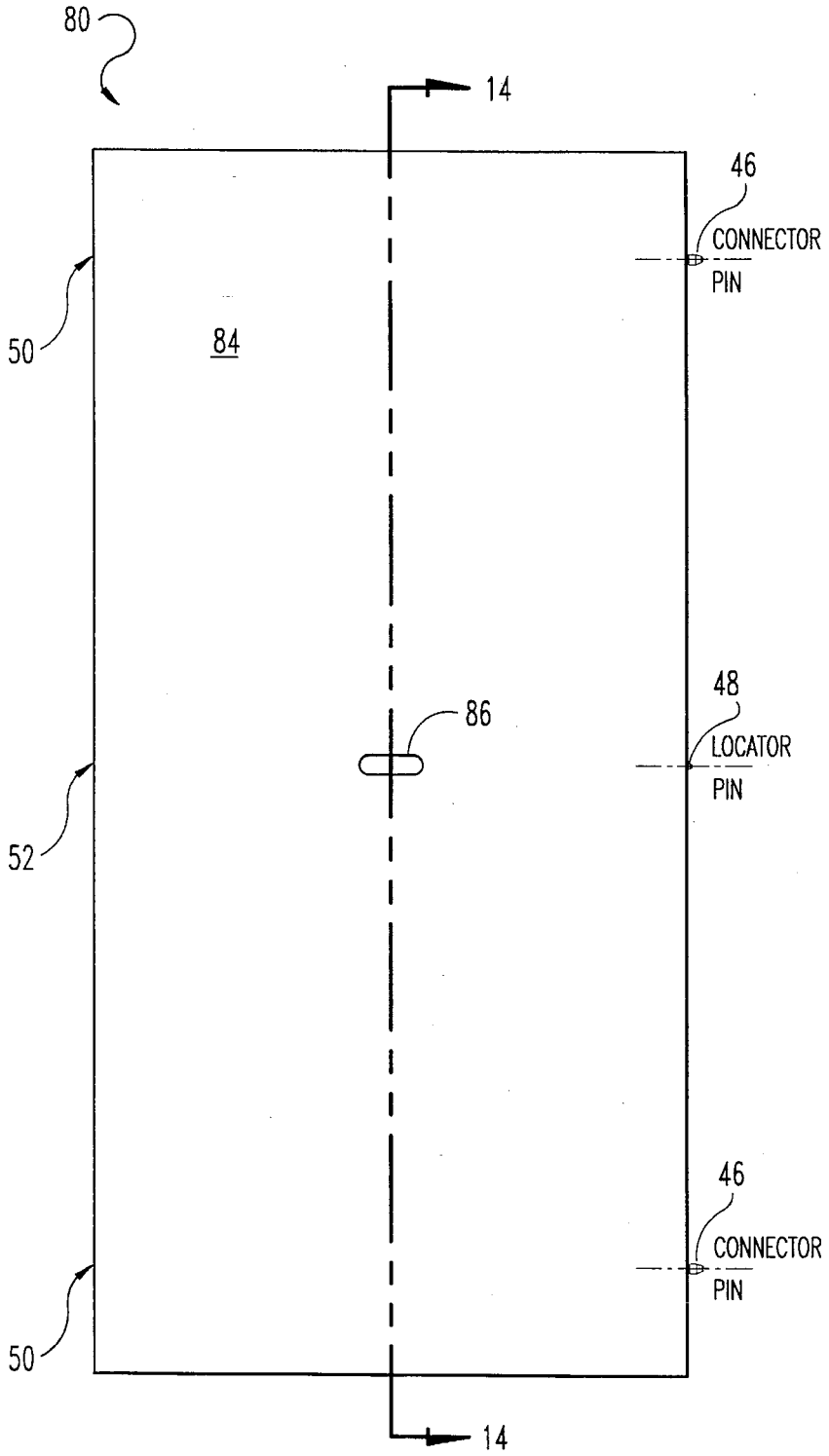
FIG. 15 is an elevational view of a second embodiment of the present invention.
Figure 16:
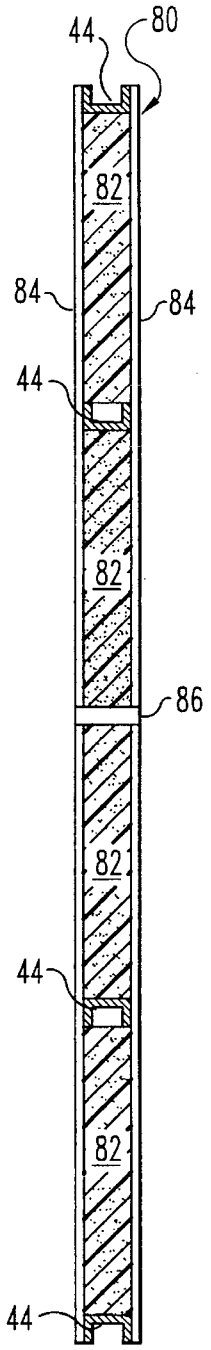
FIG. 16 is a cross sectional view of the second embodiment of the present invention.

Referring now to FIG. 15, there is illustrated a second embodiment modular wall panel of the present invention, indicated generally 80. The modular panel 80 is illustrated in cross section in the view of FIG. 16. The wall panel 80 is formed from the same frame construction as the first embodiment wall panel 40, and further includes the same connector pin 46/connector slot 50 and locator pin 48/locator slot 52 configuration. However, the spaces between adjacent horizontal support members 44 in the wall panel 80 are filled with 1½" thick cellulose foam material 82. The sections of foam 82 are sized to substantially completely fill the space within the frame of the modular panel 80, with the exception that the U-channels within the horizontal support members 44 remain unfilled. Both sides of the modular panel 80 are then covered with a decorative laminate material 84, such as laminations commonly known in the art and manufactured by Formica®, wilsonart®, etc. The outer laminate 84 is coupled to the foam and/or frame of the modular panel 80 by any convenient means, such as a spray adhesive.

Because of the low density and high strength of the cellulose foam material 82, its addition to the structure of the modular panel 80 adds essentially no weight to the finished structure, however, it is very effective in providing rigidity to the entire structure. The foam material 82 is especially useful in preventing deformation of the laminate material 84 when subjected to forces perpendicular to its surface. Optionally, an elongate hole 86 may be cut entirely through the modular panel 80 in order to provide a convenient hand hold for carrying the modular panel 80. Because the modular panel 80 is light enough to be carried with one hand, the positioning of the hole 86 substantially in the center of the modular panel 80 facilitates lifting and carrying of the panel. It will be appreciated by those skilled in the art that the hole 86 will not be seen in the final constructed exhibit display if graphics or other materials are mounted onto the modular panel 80, as is usually the case.

Figure 17:
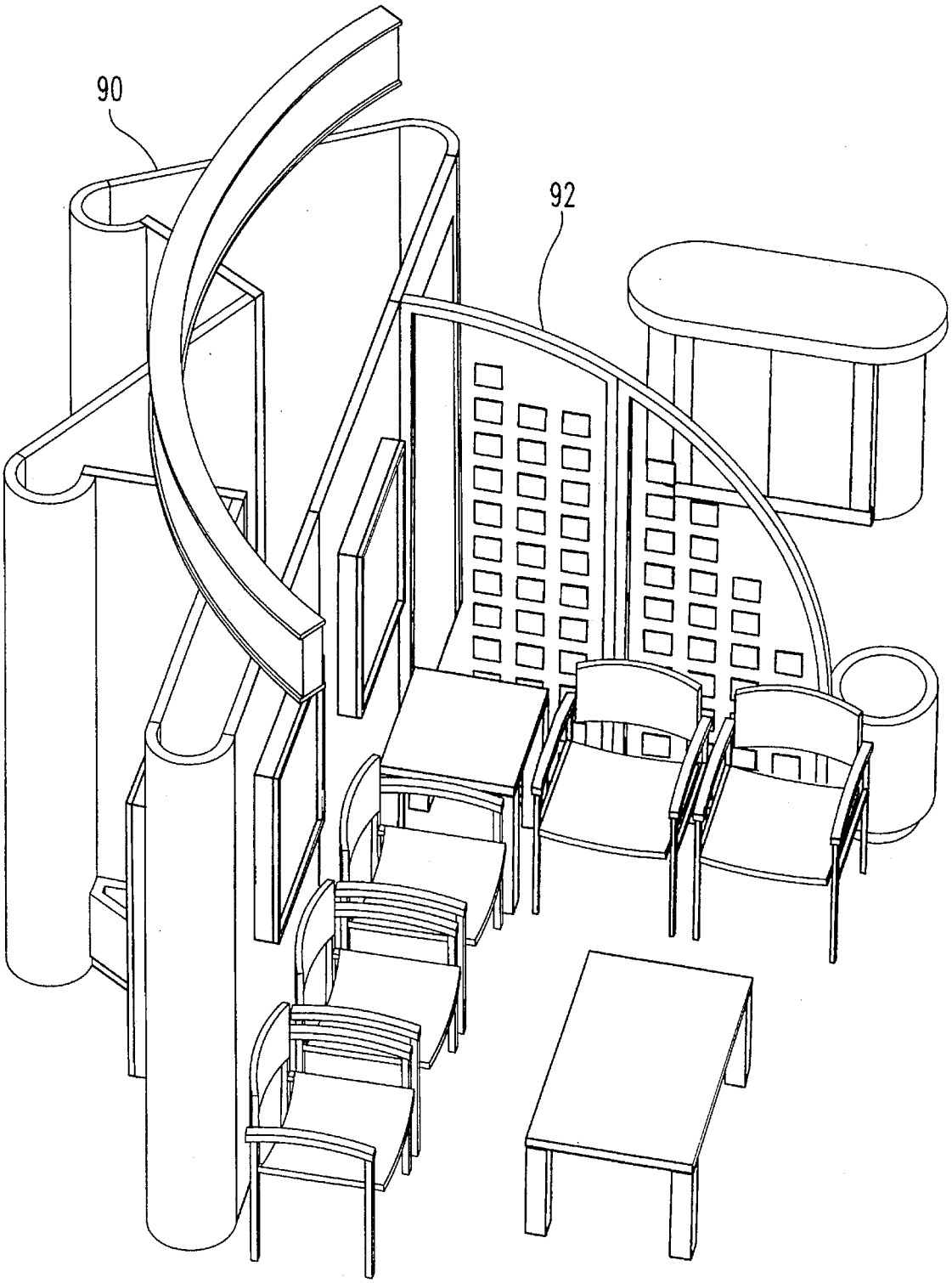
FIG. 17 is a perspective view of a third embodiment of the present invention.

Referring now to FIG. 17, there is illustrated in perspective view an example of a completed modular exhibit display constructed according to the present invention. The exhibit of FIG. 17 includes a first portion 90 coupled to a second portion 92. Both the first portion 90 and the second portion 92 are formed from the modular display panels of the present invention, as described in more detail hereinbelow. The remaining features of FIG. 17 merely illustrate a typical environment of use of the present invention.

Figure 18:
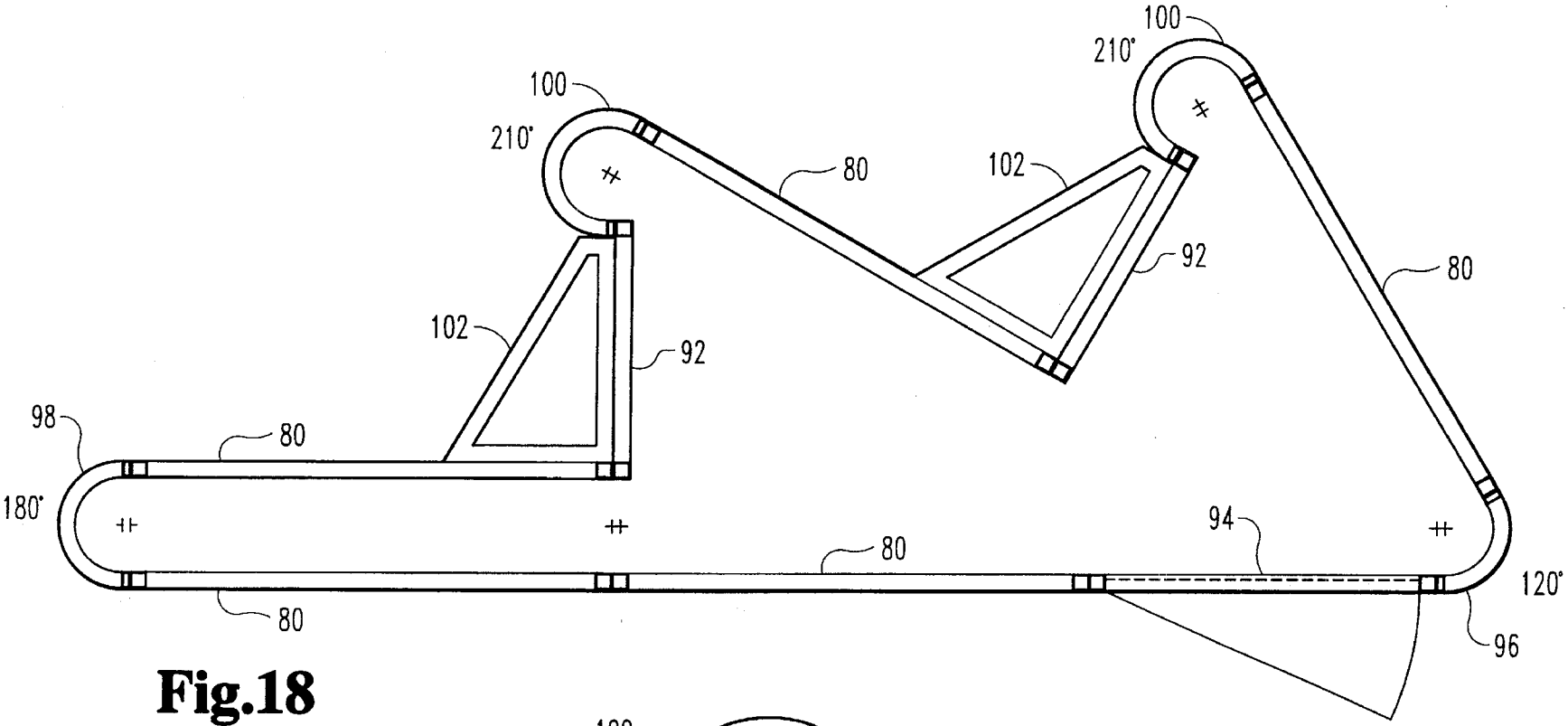
FIG. 18 is a plan view of a portion of the third embodiment of the present invention.

The first portion 90 of the exhibit display of FIG. 17 is illustrated in plan view in FIG. 18. The first portion 90 is constructed substantially from modular wall panels 80 as illustrated in FIG. 13. Additionally, the first portion 90 includes some modular wall panels with slightly different configurations from the panels 80 shown in FIG. 15. For example, there are two modular wall panels 92 which are substantially identical to the modular panel 80 with the exception that the connector pins 46, locator pin 48, connector slots 50 and locator slot 52 are located on the same side of the panel 92 as one of its display surfaces. This configuration will be readily appreciated by those skilled in the art with reference to FIG. 18.

Secondly, the first portion 90 includes a modular panel 94 which is substantially identical to the modular panel 80 of FIG. 15, with the exception that a door has been formed therein in order to allow access to the interior space of the first portion 90. The door of the modular panel 94 is easily provided by eliminating the two central horizontal support members 44 of the panel 80. By including the door in the modular panel 94, access is thereby provided to the interior space of the first portion 70 for storage of exhibit supplies, such as advertising materials or food service.

Figure 19:
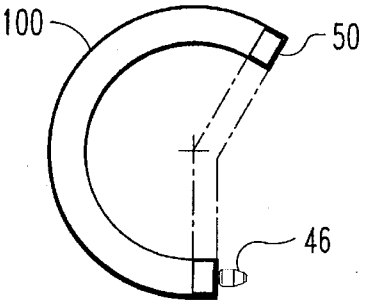
FIG. 19 is a plan view of a portion of the third embodiment of the present invention.

Finally, the first portion 90 includes several curved modular panels, such as the 120° panel 96, the 180° panel 98, and the 210° panel 100. It will be appreciated by those skilled in the art that these curved modular panels are essentially identical to the modular panel 80 with the exception that their surfaces execute a particular arc. The 210° panel 100 is illustrated in FIG. 19, in which the connector pin 46 and connector slot 50 are indicated. The mating and unmating of these curved modular panels follow the same procedure as the mating and unmating of the modular panels 40 and 80. The first portion 90 further includes planters 102 which are designed to fit with the recesses created by the shape of the various modular panels. The planters 102 are free standing and do not form a part of the present invention.

Figure 20:
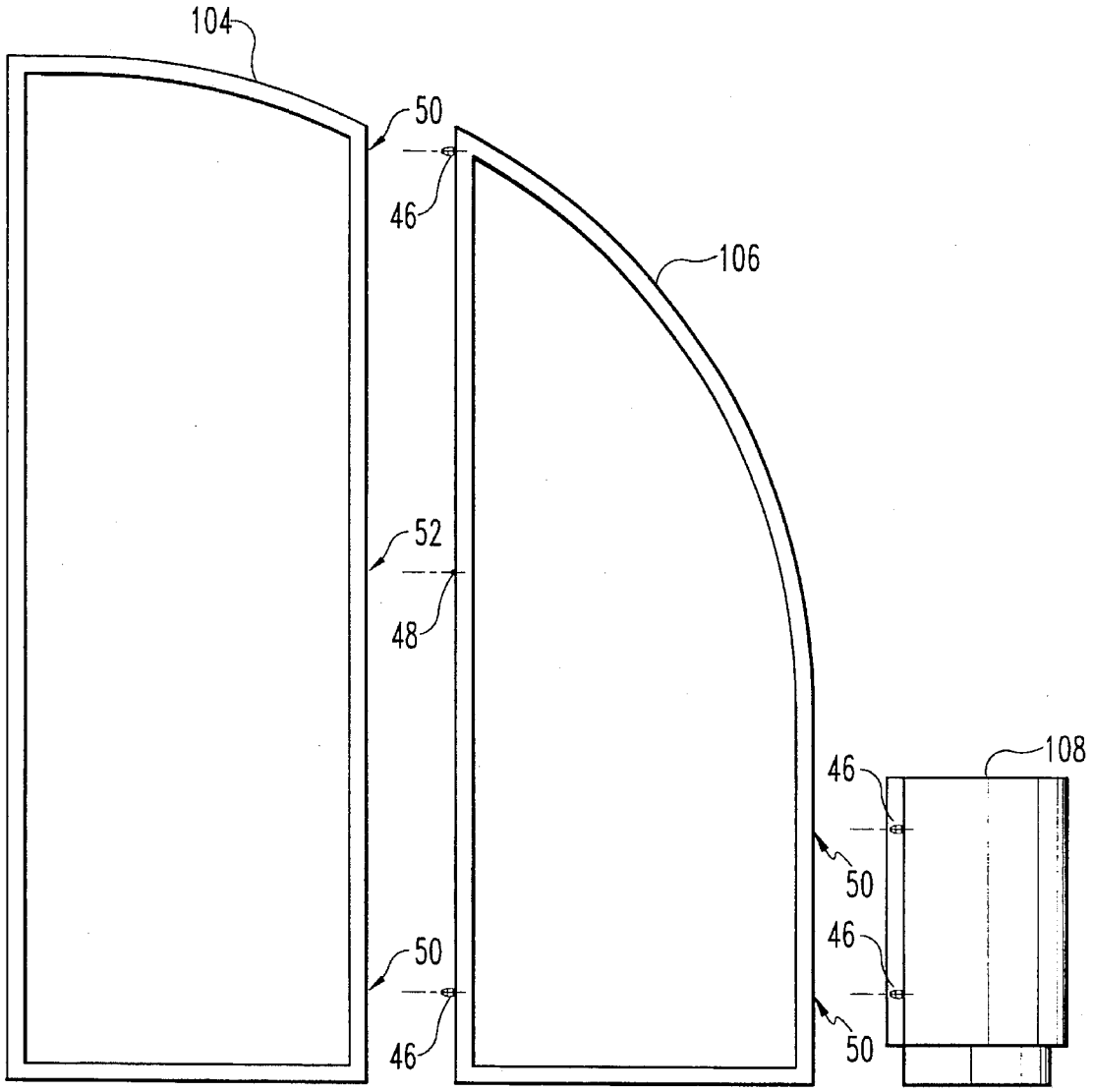
FIG. 20 is an elevational view of a portion of the third embodiment of the present invention.

The second portion 92 of the exhibit display of FIG. 17 illustrates that the modular panels of the present invention may be formed in substantially any shape in order to achieve substantially any desired aesthetic affect. As illustrated in FIG. 20, the first portion 92 is formed from a first panel 104, a second panel 106 and a cylindrical planter stand 108. The panels 104 and 106 are formed from aluminum frames but contain no horizontal cross members or foam core because, as illustrated in FIG. 17, they are laminated with a transparent Plexiglas® material in order to form window-like panels. Furthermore, the frames of the panels 104 and 106 are formed with curving shades in order to produce a divider wall having a sweeping exterior arc once the panels are assembled together. Other than these unique aspects of the second portion 92, the panels 104 and 106 are coupled to one another by the identical connector pin 46/connector slot 50 and locator pin 48/locator slot 52 configuration of the other embodiments of the present invention. Finally, the cylindrical plant stand 108 is also coupled to the panel 106 by means of a connector pin 46/connector slot 50 coupling arrangement. However, because of the relatively small height of the plant stand 108, there is no need for a locator pin 48/locator slot 52.

It will therefore be appreciated by those skilled in the art that the present invention provides for a modular panel wall system having individual wall panels which are approximately half the thickness and half the weight of prior art wall panel systems. Not only does this reduce the shipping costs associated with transporting the disassembled exhibit across the country, but it also significantly decreases the drayage costs at the exhibit site, due to the fact that the wall panels of the present invention are light enough to be handled by a single person. Even so, the panels of the present invention retain the rigidity, aesthetic quality, and durability of the wall panels of the prior art systems. Furthermore, the modular wall panels of the present invention include a system for interconnecting adjacent panels which does not require any tools or separate parts to affect such coupling.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A modular wall panel, comprising:

a first vertical support member forming a first side of the panel;

a second vertical support member forming a second side of the panel;

a plurality of horizontal support members coupled between the first and second vertical support members, thereby forming a panel frame;

a first display surface coupled to the panel frame and forming a third side of the panel;

a plurality of connector pins coupled to the first vertical support member and extending substantially perpendicular to the first side, each of the connector pins having a first diameter at a first junction between the connector pin and the first side, and a second diameter at a point on the connector pin spaced from the first junction, wherein the second diameter is larger than the first diameter; and a plurality of connector slots formed in the second vertical support member, each of the connector slots having a dogbone shape comprising two spaced apart end portions connected with a central slot, each of the end portions having a third diameter and the central slot having a first width, wherein the third diameter of the end portions is larger than the second diameter and the first width of the central slot is larger than the first diameter and smaller than the second diameter;

wherein first and second adjacent wall panels may be releasable coupled by vertically raising either the first panel with respect to the second panel or vice versa until the connector pins of one panel are aligned with one of the end portions of corresponding connector slots of the other panel, moving the one panel toward the other panel and then vertically lowering the one panel to substantially a level of the other panel such that each of the connector pins is retained in the central slot of the corresponding connector slot.

2. The modular wall panel of claim 1, further comprising:

a locator pin coupled to the first vertical support member and extending substantially perpendicular to the first side, the locator pin having a fourth diameter; and a locator slot formed in the second vertical support member, the locator slot having a second width that is larger than the fourth diameter.

3. The modular wall panel of claim 1 further comprising:

a second display surface coupled to the panel frame and forming a fourth side of the panel; and at least one foam core member substantially filling a cavity defined by the first and second vertical support members, the first and second display surfaces, and two of the plurality of horizontal support members.

4. The modular wall panel system of claim 3, wherein the foam core member comprises cellulose foam.

5. The modular wall panel of claim 3, further comprising:

handhold slot formed completely through the first and second display surfaces and the foam core member;

wherein the modular wall panel may be carried by a single person when gripping the handhold slot.

6. The modular wall panel of claim 1, wherein the first and second vertical support members are formed from substantially square aluminum tubing.

7. The modular wall panel of claim 1, wherein the horizontal support members are formed from U-shaped channel material.

8. The modular wall panel of claim 1, wherein each of the connector pins comprise:

a first cylindrical portion having an outside diameter equal to the first diameter;

a second cylindrical portion having an outside diameter equal to the second diameter;

a first frustoconical portion extending between the first and second cylindrical portions, the first frustoconical portion providing at least a partial transition between the first and second diameters; and a second frustoconical portion extending from the second cylindrical portion on a side opposite a second junction between the first frustoconical portion and the second cylindrical portion.

9. The modular wall panel of claim 8, wherein each of the connector pins further comprises:

a machine screw extending longitudinally through the first and second cylindrical portions and the first and second frustoconical portions and threadingly engaging the first vertical support member, thereby coupling the connector pin to the first vertical support member.

10. The modular wall panel of claim 2, wherein the locator pin comprises:

a first cylindrical portion having an outside diameter equal to the fourth diameter.

11. The modular wall panel of claim 10, wherein the locator pin further comprises:

a machine screw extending longitudinally through the first cylindrical portion and threadingly engaging the first vertical support member, thereby coupling the locator pin to the first vertical support member.

12. The modular wall panel of claim 1, wherein the first display surface is fiat.

13. The modular wall panel of claim 1, wherein the first display surface is curved.

14. The modular wall panel of claim 1, wherein the first display surface comprises plastic laminate material.

15. The modular wall panel of claim 6, further comprising:

first and second joining members sized to fit within an open upper end of such of the first and second vertical support members in order to couple the panel to a second panel located vertically thereabove.

* * * * *

UNITED STATES PATENT AND TRADEMARK OFFICE

CERTIFICATE OF CORRECTION

PATENT NO. : 5,561,960

DATED : October 8, 1996

INVENTOR(S) : Larry A. Minnick et al.

It is certified that error appears in the above-indentified patent and that said Letters Patent is hereby corrected as shown below:

In column 2, line 26, please change "beth" to --both--.
In column 2, line 34, please change "25" to --26--.
In column 2, line 63, please change "25" to --26--.
In column 3, line 23, please change "shaded" to -shaped--.
In column 4, line 44, please change "module" to --modular--.
In column 5, line 57, please change "1½"1"" to --1½" x 1"--
In column 6, line 56, please change "65" to --66--.
In column 7, line 36, please delete the comma.
In column 8, line 9, please change "wilsonart" to --Wilsonart--.
In column 8, line 43, please change "13" to --15--.
In column 8, line 61, please change "70" to --90--.
In column 9, line 21, please change "shades" to --shapes--.
In column 10, line 43, please insert --a-- before "handhold".

Signed and Sealed this

Fourth Day of March, 1997

*Attest:*

Bruce Lehman

BRUCE LEHMAN

*Attesting Officer*

*Commissioner of Patents and Trademarks*